US005252038A

United States Patent [19]

Mangyo et al.

[11] Patent Number: 5,252,038

[45] Date of Patent: Oct. 12, 1993

[54] HERMETIC MOTOR-DRIVEN COMPRESSOR

[75] Inventors: Masao Mangyo, Fujisawa; Takeshi Ohno, Chigasaki; Ichirou Kita, Fujisawa, all of Japan

[73] Assignee: Matsushita Electric Industrial Co., Ltd., Japan

[21] Appl. No.: 908,110

[22] Filed: Jul. 2, 1992

[30] Foreign Application Priority Data

Jul. 3, 1991 [JP] Japan ..... 3-162745

[51] Int. Cl.[5] ..... F04B 17/00; F04B 35/00

[52] U.S. Cl. ..... 417/363; 417/902

[58] Field of Search ..... 417/363, 902

[56] References Cited

U.S. PATENT DOCUMENTS

| | | | |
|---|---|---|---|
| 3,540,813 | 11/1970 | Murphy | 417/363 |
| 3,887,304 | 6/1975 | Otaki et al. | 417/902 |
| 4,431,383 | 2/1984 | Boehmler et al. | 417/363 |
| 4,591,318 | 5/1986 | Elson | 417/902 |

FOREIGN PATENT DOCUMENTS

| | | |
|---|---|---|
| 1264095 | 10/1961 | France . |
| 52-130013 | 11/1977 | Japan . |
| 1590647 | 6/1991 | U.S.S.R. . |

*Primary Examiner*—Richard A. Bertsch
*Assistant Examiner*—Charles G. Freay
*Attorney, Agent, or Firm*—Lowe, Price, LeBlanc & Becker

[57] ABSTRACT

A low noise, hermetic motor-driven compressor suitable for used in a refrigerator or an air-conditioner is disclosed in which a closed container has a spherical wall portion on which a combined motor-and-compressor assembly is supported via a suspension mechanism, and the suspension mechanism includes two snubber stays having spherical portions complementary in contour to the shape of the spherical wall portion of the closed container and welded to the spherical wall portion. The spherical wall portion increases the stiffness of the closed container, which stiffness is enhanced by the spherical portions of the snubber stays. The thus reinformed closed container is unlikely to vibrate in resonance with the vibration of the combined motor-and-compressor assembly. Thus, the hermetic motor-driven compressor is able to operate silently.

9 Claims, 3 Drawing Sheets

HERMETIC MOTOR-DRIVEN COMPRESSOR

BACKGROUND OF THE INVENTION

1. Field of the Invention

The present invention relates generally to a hermetic motor-driven compressor for use in a refrigerator, an air-conditioner or the like, and more particularly to a low noise, hermetic motor-driven compressor.

2. Description of the Prior Art

In recent years, there has been an increased demand for a low noise, hermetic motor-driven compressor (hereinafter referred to, for brevity, as "compressor").

A conventional compressor disclosed in Japanese Patent Laid-open Publication No. 52-130013 includes, as shown in FIGS. 4 through 6, a closed container 1 in which a compressor element 2 and a motor element 3 are disposed as a single combined motor-and-compressor assembly 4. The compressor element 2 is composed of a cylinder 5, a piston 6 reciprocating within the cylinder 5, a crankshaft 7 rotatable in unison with a rotor 3*a* of the motor element 3, and a connecting rod 8 for translating a rotary motion of the crankshaft 7 into a reciprocating motion of the piston 6.

A tube 9 is welded at its one end to the closed container 1. Numeral 10 is a so-called hermetic terminal hermetically welded to the closed container 1 for supplying electricity to the motor element 3. The closed container 1 has flat bottom wall portions 1*a* and 1*b* to which a flat leg 11 is welded. The combined motor-and-compressor assembly 4 is resiliently supported by four snubbers 12 each having a suspension spring 13 acting between the corresponding snubber 12 an the combined motor-and-compressor assembly 4. The snubbers 12 are welded to the flat bottom wall portions 1*a* and 1*b* of the closed container 1.

Since the leg 11 and the snubbers 12 are attached by welding to the flat bottom wall portions 1*a* and 1*b* of the closed container 1, as described above, the welding work can be performed easily and efficiently.

However, since the stiffness of flat bottom wall portions 1*a* and 1*b* is relatively low, the closed container 1 tends to vibrate and thereby produce a noise. At the same time, an operation noise of the combined motor-and-compressor assembly 4 is likely to leak out from the flat bottom wall portions 1*a* and 1*b*. Thus, the conventional compressor generates relatively large operation noises and hence cannot meet a severe noise level which is required for modern compressors.

SUMMARY OF THE INVENTION

With the foregoing drawbacks of the prior art in view, it is an object of the present invention to provide a low noise, hermetic motor-driven compressor which is capable of operating silently and hence is able to meet a severe noise level which is required for modern compressors.

A hermetic motor-driven compressor comprises a closed container having a spherical wall portion, a compressor and a motor coupled together to form a combined motor-and-compressor assembly, and suspension means, disposed in the closed container, for resiliently supporting the combined motor-and-compressor assembly within the closed container. The suspension means includes a plurality of suspension springs, and a plurality of pairs of first and second snubbers corresponding in number to the number of the suspension springs and retaining opposite ends of the respective suspension springs. The first snubbers are secured to the combined motor-and-compressor assembly. At least one plate-like snubber stay has opposite end portions to which the second snubbers are attached, and a spherical central portion complementary in contour to the shape of the spherical wall portion of the closed container and welded to the spherical wall portion.

Preferably, the snubber stay has a plurality of embossed projections on the spherical central portion. The embossed projections are snugly received in a plurality of recesses, respectively, formed in the spherical wall portion as a result of formation of embossed projections on the spherical wall portion.

Since the wall portion of the enclosed container which supports the combined motor-and-compressor assembly via the suspension is spherical other than flat and hence has a greater stiffness than the flat wall portion, the container is unlikely to vibrate in resonance with the combined motor-and-compressor assembly. In addition, the spherical wall portion is reinforced by the snubber stay, so that the operation noise of the motor-and-compressor assembly cannot leak out from the closed container. The snubber stay is preferably made of a resilient material such as spring steel. The resilient snubber stay gives a damping effect which is added up with a damping effect attained by the suspension springs. With this combined damping effect, the vibration of the combined motor-and-compressor assembly is considerably reduced and thus the hermetic compressor operates silently.

The above and other objects, features and advantages of the present invention will become more apparent from the following description when making reference to the detailed description and the accompanying sheets of drawings in which a preferred structural embodiment incorporating the principles of the present invention is shown by way of illustrative example.

DETAILED DESCRIPTION OF THE INVENTION

Figure 1:
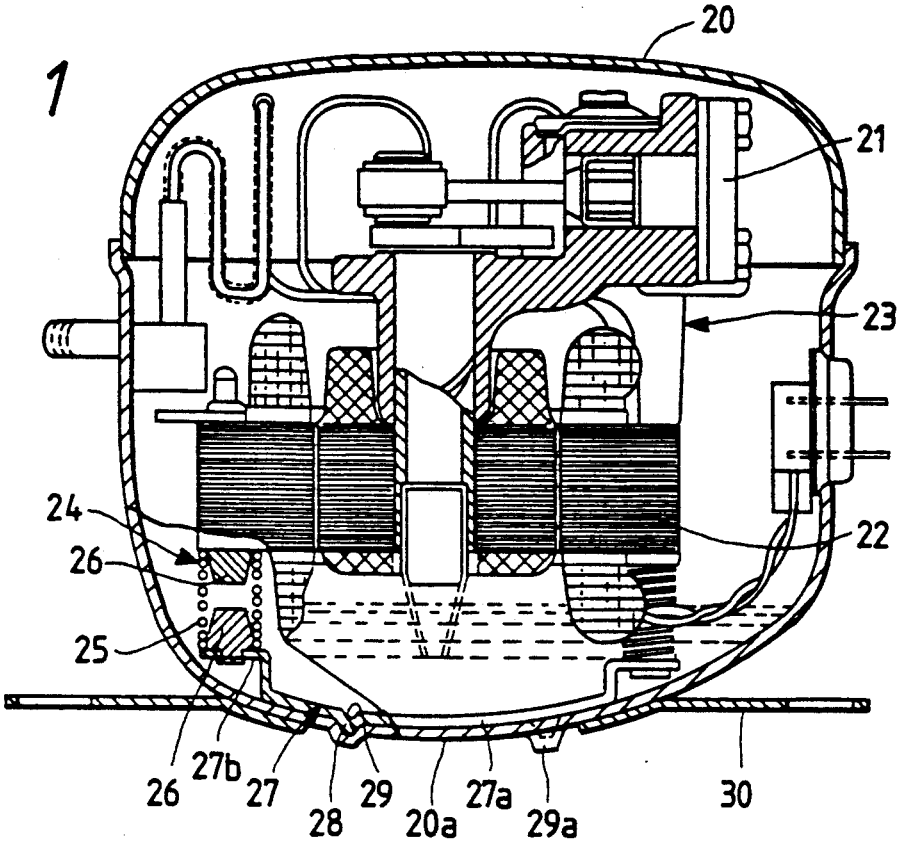
FIG. 1 is a schematic longitudinal cross-sectional view of a compressor according to the present invention.
Figure 2:
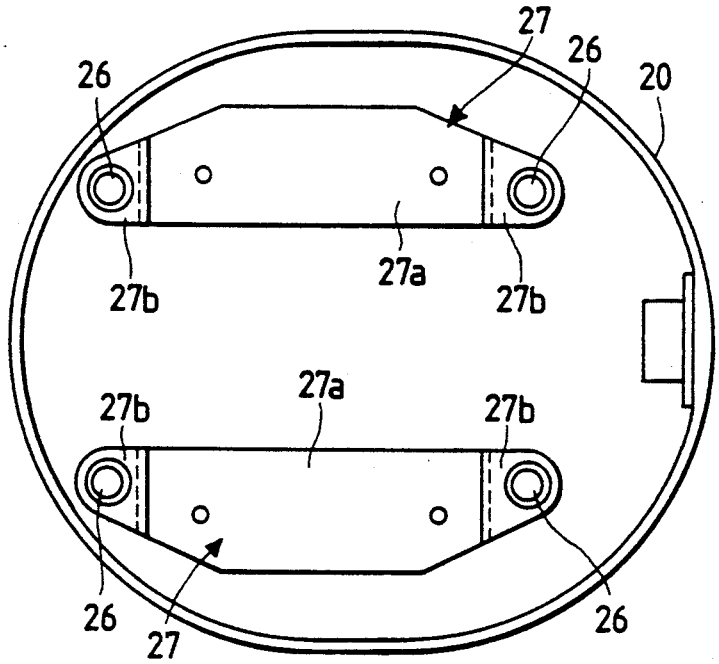
FIG. 2 is a diagrammatical plan view showing an internal structure of a closed container of the compressor.
Figure 3:
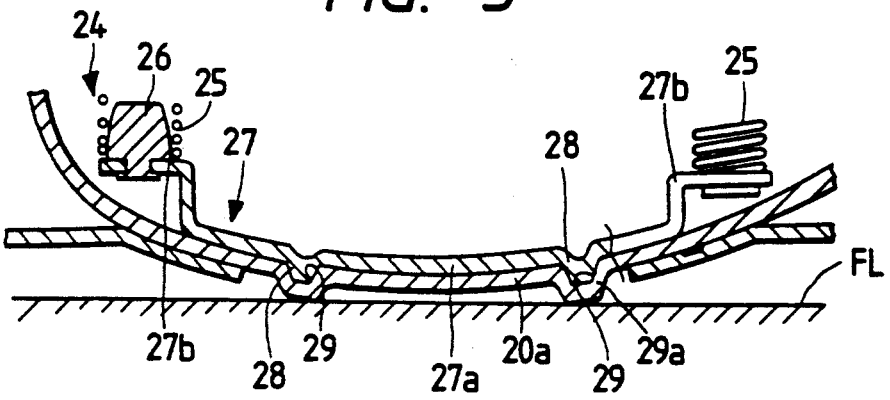
FIG. 3 is an enlarged cross-sectional view of a bottom portion of the compressor shown in FIG. 1.
Figure 5:
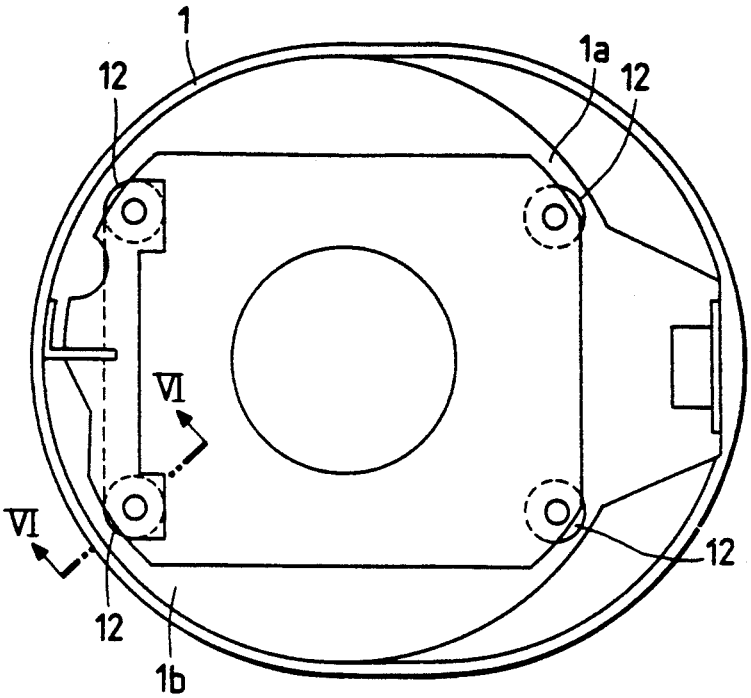
FIG. 5 PRIOR ART
FIG. 5 is a diagrammatical plan view showing the an internal structure of a closed container of the conventional compressor.
Figure 6:
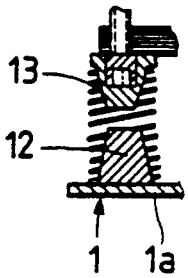
FIG. 6 PRIOR ART
FIG. 6 is a cross-sectional view taken along VI—VI of FIG. 5.

As shown in FIGS. 1 through 3, a hermetic motor-driven compressor according to the present invention includes a closed container 20 having a spherical bottom wall portion 20*a*, a compressor element 21 and a motor element 22 coupled together to jointly form a combined motor-and-compressor assembly 23, and a suspension means or mechanism 24 disposed in the closed container 20 for resiliently supporting the combined motor-and-compressor assembly 23 within the closed container 20. The combined motor-and-compressor assembly 23 is structurally and functionally the same as one 4 of the conventional compressor described above with reference to FIGS. 4–6, and a further description thereof can be omitted.

The suspension mechanism 24 includes a plurality of suspension springs 25 (four in the illustrated embodiment) in the form of compression coil springs, a plurality of pairs of upper and lower frustoconical snubbers 26 corresponding in number to the number of the suspension springs 25 and retaining opposite ends of the respective suspension spring 25, and a pair of elongate plate-like snubber stays 27 each holding thereon two lower snubbers 26 at opposite ends thereof. The upper snubbers 26 are attached to the motor element 22 of the combined motor-and-compressor assembly 23.

Each of the snubber stays 27 includes a downwardly convex, spherical central portion 27*a* substantially complementary in contour to the shape of the spherical bottom wall portion 20*a* of the closed container 20, and upwardly offset, inverted L-shaped opposite end portions 27*b* on which the two snubbers 26 are fixedly mounted. The spherical central portion 27*a* is welded to the spherical bottom wall portion 20*a* to attach the snubber stay 27 to the closed container 20. The spherical central portion 27*a* has two projections 28 formed by embossing and spaced from one another in the longitudinal direction of the snubber stay 27. The projections 28 are snugly received in two recesses 29 formed in the spherical bottom wall portion 20*a* as a result of formation of two embossed projections 29*a*. The projections 29*a* on the spherical bottom wall portion 20*a* project outwardly (downwardly in FIGS. 1 and 3) from a plane of a leg 30 welded to the spherical bottom wall portion 20*a* of the closed container 20 so that the projections 29*a* are engageable with a floor FL (FIG. 3) to prevent the hermetic motor-driven compressor from becoming wobbly or unstable when the hermetic motor-driven compressor is disposed on the floor FL.

The snubber stays 27 are preferably made of a resilient material such as spring steel. With the suspension mechanism 24 thus constructed, vibrations generated during operation of the combined motor-and-compressor assembly 23 can be dampened or absorbed in two stages, that is, first by the suspension springs 25 and subsequently by the resilient snubber stays 27. Thus, a considerable reduction in the noise level can be attained.

Figure 4:
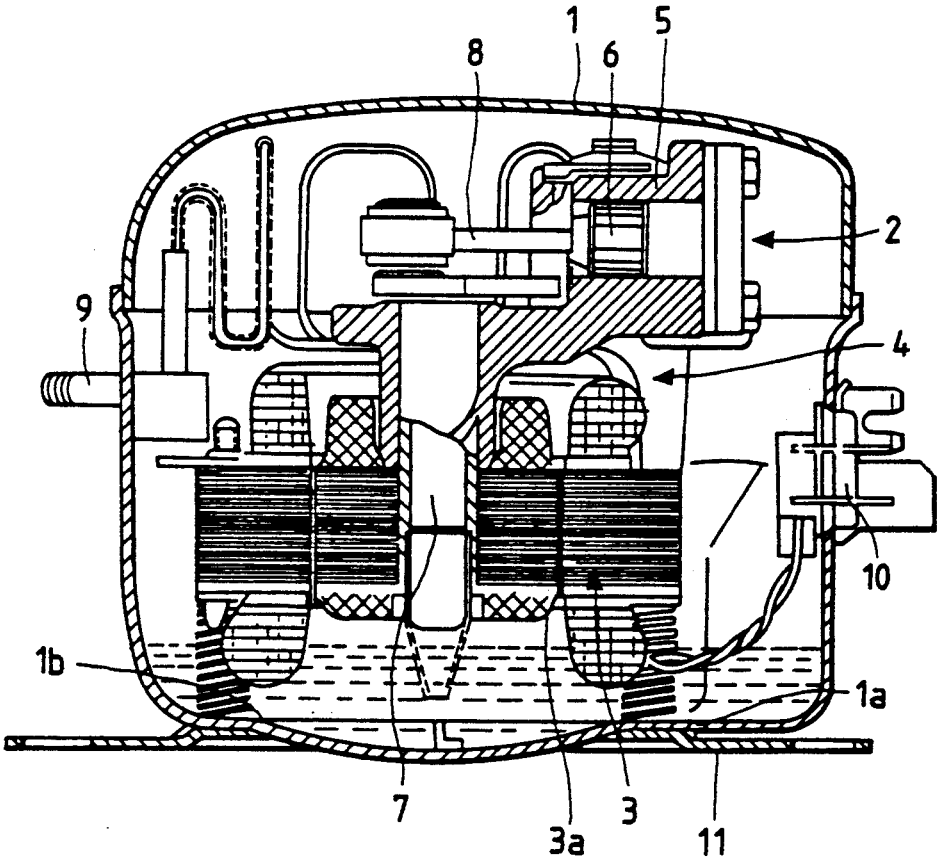
FIG. 4 PRIOR ART
FIG. 4 is a schematic longitudinal cross-sectional view of a conventional compressor.

When the hermetic motor-driven compressor of the type concerned is operating, the combined motor-and-compressor assembly generates an operation noise having frequencies in the rage of between 2 and 3 kHz. In the case of the conventional compressor whose container 1 has flat bottom wall portions 1*a* and 1*b*, as shown in FIG. 4, the flat bottom wall portions 1*a* and 1*b* is resonant with the operation noise of the frequencies specified above. Thus, the operation noise of the compressor as a whole is greatly amplified. On the other hand, in the case of the hermetic motor-driven compressor of this invention, the closed container 20 has a resonance frequency around 4 kHz and hence is not resonant with the operation noise of the combined motor-and-compressor assembly 23 even if the suspension mechanism 24 is directly attached to the spherical bottom wall portion 20*a*. This is because the closed container 20 including a spherical bottom wall portion 20*a* has a greater stiffness than the conventional closed container 1 having flat bottom wall portions 1*a* and 1*b*. In addition, the spherical bottom wall portion 20*a* of the container 20 is reinforced by the spherical central portions 27*a* of the snubber stays 27. Furthermore, the operation noise of the combined motor-and-compressor assembly 23 is considerably reduced by the combined damping effect of the suspension springs 25 and the resilient stays 27. Thus, the operation noise of the hermetic motor-driven compressor of this invention is considerably reduced to such an extent that a severe noise level needed for modern compressors is satisfied.

Obviously, various minor changes and modifications of the present invention are possible in the light of the above teaching. It is therefore to be understood that within the scope of the appended claims the invention may be practiced otherwise than as specifically described.

What is claimed is:

1. A hermetic motor-driven compressor comprising:
(a) a closed container having a spherical wall portion;
(b) a compressor and a motor coupled together to form a combined motor-and-compressor assembly; and
(c) suspension means, disposed in said closed container, for resiliently supporting said combined motor-and-compressor assembly within said closed container, said suspension means including
(i) a plurality of suspension springs,
(ii) a plurality of pairs of first and second snubbers corresponding in number to the number of said suspension springs and retaining opposite ends of the respective suspension springs, said first snubbers being secured to said combined motor-and-compressor assembly, and
(iii) at least one plate-like snubber stay having opposite end portions to which said second snubbers are attached, and a spherical central portion complementary in contour to the shape of said spherical wall portion of said closed container and welded to said spherical wall portion.

2. A hermetic motor-driven compressor comprising:
(a) a closed container having a spherical wall portion;
(b) a compressor and a motor coupled together to form a combined motor-and-compressor assembly; and
(c) suspension means, disposed in said closed container, for resiliently supporting said combined motor-and-compressor assembly within said closed container, said suspension means including
(i) a plurality of suspension springs,
(ii) a plurality of pairs of first and second snubbers corresponding in number to the number of said suspension springs and retaining opposite ends of the respective suspension springs, said first snubbers being secured to said combined motor-and-compressor assembly, and
(iii) at least one plate-like snubber stay having opposite end portions to which said second snubbers are attached, and a spherical central portion complementary in contour to the shape of said spherical wall portion of said closed container and welded to said spherical wall portion, wherein said snubber stay has a plurality of embossed projections on said spherical central portion, said embossed projections being snugly received in a plurality of recesses, respectively, formed in said spherical wall portion as a result of formation of embossed projections on said spherical wall portion.

3. A hermetic motor-driven compressor according to claim 2, wherein said hermetic motor-driven compressor is of the type which is disposed on a floor, and wherein said embossed projections on said spherical wall portion are engageable with said floor when said hermetic motor-driven compressor is disposed on the floor.

4. A hermetic motor-driven compressor comprising:

(a) a closed container having a spherical wall portion;

(b) a compressor and a motor coupled together to form a combined motor-and-compressor assembly; and (c) suspension means, disposed in said closed container, for resiliently supporting said combined motor-and-compressor assembly within said closed container, said suspension means including (i) a plurality of suspension springs, (ii) a plurality of pairs of first and second snubbers corresponding in number to the number of said suspension springs and retaining opposite ends of the respective suspension springs, said first snubbers being secured to said combined motor-and-compressor assembly, and (iii) at least one plate-like snubber stay having opposite end portions to which said second snubbers are attached, and a spherical central portion complementary in contour to the shape of said spherical wall portion of said closed container and welded to said spherical wall portion, wherein said opposite end portions of said snubber stay are offset from said spherical central portion and resiliently deformable.

5. A hermetic motor-driven compressor comprising:

(a) a closed container having a spherical wall portion;

(b) a compressor and a motor coupled together to form a combined motor-and-compressor assembly; and (c) suspension means, disposed in said closed container, for resiliently supporting said combined motor-and-compressor assembly within said closed container, said suspension means including (i) a plurality of suspension springs, (ii) a plurality of pairs of first and second snubbers corresponding in number to the number of said suspension springs and retaining opposite ends of the respective suspension springs, said first snubbers being secured to said combined motor-and-compressor assembly, and (iii) at least one plate-like snubber stay having opposite end portions to which said second snubbers are attached, and a spherical central portion complementary in contour to the shape of said spherical wall portion of said closed container and welded to said spherical wall portion, wherein the number of said first and second snubber pairs is four, and wherein the number of said at least one snubber stay is two, said opposite end portions of each of said two snubber stays being offset from said spherical central portion and resiliently deformable, said resiliently deformable opposite end portions supporting thereon two of said four second snubbers.

6. A hermetic motor-driven compressor comprising:

(a) a closed container having a spherical wall portion;

(b) a compressor and a motor coupled together to form a combined motor-and-compressor assembly; and (c) suspension means, disposed in said closed container, for resiliently supporting said combined motor-and-compressor assembly within said closed container, said suspension means including (i) a plurality of suspension springs, (ii) a plurality of pairs of first and second snubbers corresponding in number to the number of said suspension springs and retaining opposite ends of the respective suspension springs, said first snubbers being secured to said combined motor-and-compressor assembly, and (iii) at least one plate-like snubber stay made of resilient material and having opposite end portions to which said second snubbers are attached, said resilient snubber stay being secured to said spherical wall portion of said closed container.

7. A hermetic motor-driven compressor according to claim 6, wherein said resilient snubber stay is made of spring steel and welded to said spherical wall portion.

8. A hermetic motor-driven compressor according to claim 6, wherein:

said snubber stay made of resilient material is structurally independent of the closed container.

9. A hermetic motor-driven compressor according to claim 8, wherein:

said snubber stay has a spherical central portion complementary in contour to the shape of the spherical wall portion of the closed container and is secured thereto.

* * * * *

UNITED STATES PATENT AND TRADEMARK OFFICE

CERTIFICATE OF CORRECTION

PATENT NO. : 5,252,038

DATED : October 12, 1993

INVENTOR(S) : Masao Mangyo et al

It is certified that error appears in the above-indentified patent and that said Letters Patent is hereby corrected as shown below:

On the title page, please delete the Assignee information and insert the following therefor:

--[73] Assignee: Matsushita Refrigeration Company, Japan--

Signed and Sealed this

Second Day of August, 1994

*Attest:*

*Attesting Officer*

BRUCE LEHMAN

*Commissioner of Patents and Trademarks*